United States Patent [19]

Buxton

[11] Patent Number: 5,011,503

[45] Date of Patent: Apr. 30, 1991

[54] FUEL COMPOSITIONS

[75] Inventor: John P. Buxton, Handbridge, United Kingdom

[73] Assignee: Shell Oil Company, Houston, Tex.

[21] Appl. No.: 468,306

[22] Filed: Jan. 22, 1990

[30] Foreign Application Priority Data

Jun. 2, 1989 [GB] United Kingdom ..... 8902549

[51] Int. Cl.[5] ..... C10L 1/18

[52] U.S. Cl. ..... 44/322

[58] Field of Search ..... 44/57, 77, 322; 568/563

[56] References Cited

U.S. PATENT DOCUMENTS

| | | | |
|---|---|---|---|
| 2,537,853 | 1/1951 | Pezzaglia | 44/57 |
| 2,580,015 | 12/1951 | George | 44/57 |
| 2,763,537 | 9/1956 | Barusch et al. | 44/57 |
| 2,891,851 | 6/1959 | Bailey et al. | 44/57 |
| 3,082,236 | 3/1963 | Mageli et al. | 44/57 |
| 3,468,962 | 9/1969 | Ballini et al. | 568/563 |
| 4,549,883 | 10/1985 | Purcell et al. | 44/57 |
| 4,622,351 | 11/1986 | Van | 525/316 |
| 4,690,976 | 9/1987 | Hahnfeld | 525/240 |

OTHER PUBLICATIONS

Kirsch et al., *Combustion & Flame,* vol. 43, (1981), pp. 11–21.

*Primary Examiner*—Margaret B. Medley

[57] ABSTRACT

A hydrocarbon-based fuel to which has been added a minor amount, sufficient to increase the cetane value of the fuel, of a perketal of the formula $$R^2R^3C(OOR^1)_2$$

wherein $R^1$ is a $C_{4-10}$ tertiary alkyl group and $R^2$ and $R^3$ together with the attached C atom form a cycloalkane ring optionally substituted by one or more $C_{1-4}$ alkyl radicals or other essentially inert substituents, such as halogen.

7 Claims, No Drawings

FUEL COMPOSITIONS

FIELD OF THE INVENTION

This invention relates to hydrocarbon-based fuels, especially diesel fuels, having improved ignition and combustion characteristics, or cetane ratings, by the addition of a peroxide-type compound.

BACKGROUND OF THE INVENTION

Hydrocarbon distillates and residue-containing oils having characteristics which render them otherwise suitable for use as fuels for compression-ignition or diesel engines, or other atomising or vaporising-type burners, frequently have igition characteristics that render them unsuitable or only poorly suitable for such use. Fuels that have poor ignition characteristics, i.e., relatively high spontaneous ignition temperatures, exhibit an undesirably long ignition lag, between the time the fuel is injected into a zone of combustion and the time when the fuel ignites. In diesel engines, for example, a large ignition lag results in combustion of the fuel and the development of pressure over an improper portion of the crank angle period and piston stroke, resulting in knocking, rough engine operation, incomplete combustion in the combustion zone, power loss, and ultimately detriment to the engine.

To overcome these ignition or combustion problems, the fuel may be refined to produce a higher proportion of straight chain hydrocarbons similar to the original industry standard, cetane. The ignition quality of a diesel fuel is normally expressed in terms of its cetane number. The cetane number of a given fuel is defined as the percent proportion of cetane (a fast-burning $C_{16}$ paraffinic constituent) in a $\alpha$-methylnaphthalene (a slow-burning aromatic material) that will match the performance of the fuel at the same compression ratio in a standard test engine.

Various agents, including nitrates such as 2-ethylhexyl nitrate, have been used to improve cetane ratings. Certain nitrate esters are described for this purpose in EP-A-0146381. However, nitrates can give rise to $NO_x$ emissions in exhaust, and this is environmentally undesirable.

Peroxides have been widely used as free radical inhibitors (curing agents) for the polymer industry. Some have been proposed as cetane improvers. For example Kirsch et al, Combust. Flame 43 (1981) 11–21, describe the use of di-tert-butyl peroxide as well as certain nitrates for this purpose.

U.S. Pat. No. 3,468,962 describes the preparation of "peroxyacetals and peroxyketals" of the formula $R^1OO—CR^2R^3—OR^4$ from alkylidenediperoxides of the formula $R^2R^3C(OOR^1)_2$. The latter are in fact perketals as the term is now understood and as it is used herein. $CR_2R_3$ can be a cyclaliphatic radical. The products are said to be useful as agents for improving the cetane number of gasolines.

SUMMARY OF THE INVENTION

According to the present invention, the cetane value of a hydrocarbon-based fuel is increased by the addition of a minor amount of a perketal of the formula $R^2R^3C(OOR^1)_2$ wherein $R^1$ is a $C_{4-10}$ tertiary alkyl group and $R^2$ and $R^3$ together with the attached C atom from a cyclalkane ring optionally substituted by one or more $C_{1-4}$ alkyl radicals or other essentially inert substituents, such as one or more halogen atoms, or the like.

DESCRIPTION OF THE INVENTION

The fuel is, say, petroleum. It is preferably a diesel fuel, i.e., of the type for use in diesel engines and other atomising or vaporising type burners. By "diesel types", "fuel compositions boiling in the diesel range", or similar language, is meant those petroleum fractions from which the fuel is derived which are useful as fuel oil, gas oil and diesel oil and which distill above the kerosene fraction and below the lubricating oil fraction, that is, between about 250° C. and about 400° C.

The perketals used in the invention are employed in hydrocarbon-based fuels in an amount sufficient to improve the ignition quality or cetane rating of the fuel. This amount will vary somewhat according to the nature of the fuel, such as the base stock from which it is formed, and properties which may be varied by refining of the fuel. These cetane improving agents can be added to diesel fuel fractions as single components, or a mixture of several of these agents can be used. Normally, a noticeable improvement in the ignition quality of a fuel oil will be obtained by incorporating therein as little as 0.05% per volume of the perketal, and the use of about 0.5 to about 2.5% by volume will result in a marked improvement. The improvement in cetane rating per unit volume increment of nitrate esters often gradually declines somewhat at proportions in the range of 0.5 to 1% by volume, but that effect is not seen in this case.

Perketals conforming to the above general formula can be employed as cetane-improving agents where each of the designated alkyl groups includes a greater number of carbon atoms than represented above. As the size of the molecule and the carbon content increase much beyond what is defined by the above formula, the improvement in cetane rating may diminish. In general, as the carbon content decreases, the cetane rating improvement increases. Relatively small molecules, or those containing relatively small amounts of carbon, present increased hazards owing to the volatility and the relatively explosive character of some such compounds. Thus the compounds represented by the above formula and defined pendant radicals represent a compromise between optimum cetane improvement and practical handling and storage considerations of the cetane improving agents themselves. It is preferred that $R^1$ is tert-butyl and/or that $CR^2R^3$ is cyclohexylidene optionally substituted by one or more $CH_3$ groups. Particularly preferred perketals are 1,1-bis(tert-butylperoxy)cyclohexane and 1,1-bis(tert-butylperoxy)-3,3,5-trimethylcyclohexane.

The perketals used in the invention are known per se, or can be prepared by known methods. Perketals of the type used in this invention are described as starting materials in U.S. Pat. No. 3,468,962, and methods for their preparation are described therein, which disclosures are incorporated herein by reference.

The cetane-improving agents used in the present invention can be incorporated in the hydrocarbon-based fuels disclosed herein in any suitable manner. These perketals are normally soluble in paraffinic as well as aromatic hydrocarbons in the proportions disclosed herein and, therefore, can be incorporated directly in the fuels. However, since the cetane-improving agents of the present invention are normally used in very small amounts, it may be preferable, from the standpoints of facilitating formation of a homogeneous mixture and also accurately measuring the correct proportions, to employ the cetane-improving agents in the form of a concentrated or stock solution in either a solvent which is compatible with the fuel, or the fuel itself.

The hydrocarbon-based fuel compositions of this invention may contain, in addition to the perketal, other additives to improve the fuels in one or more respects. For example, the fuel compositions of this invention may also contain oxidation inhibitors, anti-foam agents and other ignition quality or combustion-improvement agents.

The following examples illustrate the invention which should not be regarded as limiting the invention in any way.

EXAMPLES

A fuel having a cetane value of 45 was treated by the addition of various amounts of 1,1-bis(tert-butylperoxy)cyclohexane and 1,1-bis(tert-butylperoxy)-3,3,5-trimethylcyclohexane, hereinafter abbreviated as DBPCH and DBPTMCH. The results are tabulated below. The cetane values are averages of three tests in each case. The data indicate that both perketals give an increase of nearly 20 in cetane rating, at a concentration of 1% v/v. Under the same conditions, 1% of the acyclic analogue 2,2-bis(tert-butylperoxy)butane increased the cetane value by 11, to 56, 1% di-tert-butyl peroxide by about 13 to 58.4, and 1% 2-ethylhexyl nitrate by slightly more.

| Additive | Amount wrt Fuel (% v/v) | Cetane Rating |
|---|---|---|
| — | — | 45 |
| DBPCH | 0.12 | 51.5 |
| DBPCH | 0.25 | 54.1 |

-continued

| Additive | Amount wrt Fuel (% v/v) | Cetane Rating |
|---|---|---|
| DBPCH | 0.30 | 54.7 |
| DBPCH | 0.50 | 57.1 |
| DBPCH | 0.77 | 58.7 |
| DBPCH | 1.01 | 64.1 |
| DBPCH | 1.29 | 66.7 |
| DBPCH | 1.81 | 71.5 |
| DBPTMCH | 0.05 | 48.1 |
| DBPTMCH | 0.1 | 50.5 |
| DBPTMCH | 0.2 | 50.7 |
| DBPTMCH | 0.4 | 55.8 |
| DBPTMCH | 1.0 | 62.7 |

What is claimed is:

1. A diesel-based fuel to which has been added a minor amount, sufficient to increase the cetane value of the fuel, of a perketal of the formula $$R^2R^3C(OOR^1)_2$$

wherein $R^1$ is $C_{4-10}$ tertiary alkyl group and $R^2$ and $R^3$ together with the attached C atom form a cycloalkane ring substituted by moieties selected from the group consisting of hydrogens, $C_{1-4}$ alkyls, halogens, and mixtures thereof.

2. A fuel according to claim 1, wherein the amount is 0.05 to 5% by volume of the fuel.

3. A fuel according to claim 1 or 2 wherein the amount is 0.5 to 2.5% by volume of the fuel.

4. A fuel according to claim 1 or 2 wherein $R^1$ is tert-butyl.

5. A fuel according to claim 1 or 2 wherein $R^2R^3$—C is cyclohexylidene substituted by n $CH_3$ groups where n is 0 to 10.

6. A fuel according to claim 5, wherein the perketal is 1,1-bis(tert-butylperoxy)cyclohexane or 1,1-bis(tert-butylperoxy)-3,3,5-trimethylcyclohexane.

7. A fuel according to claim 1 or 2 wherein the fuel boils in the diesel range.

* * * * *